US010952520B2

(12) United States Patent
Neville

(10) Patent No.: US 10,952,520 B2
(45) Date of Patent: Mar. 23, 2021

(54) SYSTEMS AND METHODS FOR CATCHING BEARD HAIR TRIMMINGS

(71) Applicant: David Andrew Neville, Cincinnati, OH (US)

(72) Inventor: David Andrew Neville, Cincinnati, OH (US)

( * ) Notice: Subject to any disclaimer, the term of this patent is extended or adjusted under 35 U.S.C. 154(b) by 61 days.

(21) Appl. No.: 16/221,231

(22) Filed: Dec. 14, 2018

(65) Prior Publication Data

US 2019/0200734 A1 Jul. 4, 2019

Related U.S. Application Data

(60) Provisional application No. 62/611,420, filed on Dec. 28, 2017.

(51) Int. Cl.
*A45D 44/16* (2006.01)

(52) U.S. Cl.
CPC ..... *A45D 44/16* (2013.01)

(58) Field of Classification Search
CPC .. A45D 44/16; A47G 29/12095; A47G 29/14; A47G 2029/144; A47B 1/06; A47B 1/08; A47B 5/02; A47K 1/06
USPC ..... 232/43.1, 43.4, 44; 132/212; 2/50; 312/209; 108/67, 152, 25, 42
See application file for complete search history.

(56) References Cited

U.S. PATENT DOCUMENTS

| | | | | |
|---|---|---|---|---|
| 2,876,471 | A | 3/1959 | Kraemer | |
| 3,782,443 | A | 1/1974 | Clauss et al. | |
| 4,997,021 | A | 3/1991 | Brutsaert | |
| 7,509,688 | B2 | 3/2009 | Gregg | |
| 9,528,318 | B2 | 12/2016 | Huang et al. | |
| 10,244,848 | B1 * | 4/2019 | Javaherian | A45D 42/10 |
| 2005/0033259 | A1 | 2/2005 | Stravitz | |
| 2011/0108451 | A1 | 5/2011 | Sack et al. | |
| 2015/0265031 | A1 * | 9/2015 | Roett-Oconnor | A45D 42/10 132/288 |
| 2017/0013945 | A1 * | 1/2017 | Galekovic | A45C 9/00 |
| 2017/0265639 | A1 * | 9/2017 | Kenon | A45D 44/16 |
| 2018/0035847 | A1 * | 2/2018 | Purvis | A47K 1/06 |
| 2018/0064233 | A1 * | 3/2018 | Riley | A46B 3/005 |
| 2018/0199697 | A1 * | 7/2018 | Staples | A45D 44/16 |
| 2019/0200734 | A1 * | 7/2019 | Neville | A45D 44/16 |
| 2020/0046104 | A1 * | 2/2020 | Lopez | A47K 1/06 |

OTHER PUBLICATIONS

International Search Report and Written Opinion of the International Searching Authority for International Patent App. No. PCT/US2018/065828 dated Mar. 18, 2019; 12 pages.

* cited by examiner

*Primary Examiner* — William L Miller
(74) *Attorney, Agent, or Firm* — Ulmer & Berne LLP

(57) ABSTRACT

Disclosed is a personal grooming device for catching, holding and disposing trimmed hair, including a retractable drawer coupled to an enclosure by a collapsible arm assembly, with a flexible sheet rolled onto a roller inside the enclosure. A bias spring biases rotation of the roller within the enclosure to maintain tension on the sheet as the drawer is extended or retracted from the enclosure. A removable bin is coupled to the enclosure, the bin having an enclosed space to capture trimmed hair as the sheet is retracted and rolled onto the roller. The bin is easily removed for disposing of the trimmed hair. The device is mountable to a mirror using suction cups, Velcro, or other attachment system.

11 Claims, 5 Drawing Sheets

SYSTEMS AND METHODS FOR CATCHING BEARD HAIR TRIMMINGS

REFERENCE TO RELATED APPLICATION

The present application is a non-provisional application that claims priority to U.S. provisional application Ser. No. 62/611,420, filed Dec. 28, 2017, and hereby incorporates the same application by reference in its entirety.

TECHNICAL FIELD

Embodiments of the technology relate, in general, to personal grooming technology, and in particular to systems and methods for catching, holding and disposing trimmed hair.

SUMMARY

Disclosed is a personal grooming device for catching, holding and disposing trimmed hair, including a retractable drawer coupled to an enclosure by a collapsible arm assembly, with a flexible sheet rolled onto a roller inside the enclosure. A bias spring biases rotation of the roller within the enclosure to maintain tension on the sheet as the drawer is extended or retracted from the enclosure. A removable bin is coupled to the enclosure, the bin having an enclosed space to capture trimmed hair as the sheet is retracted and rolled onto the roller. The bin is easily removed for disposing of the trimmed hair. The device is mountable to a mirror using suction cups, Velcro, or other attachment system.

In one embodiment, a hair catching and storage device includes an enclosure removably connected to a bin, the enclosure having an opening, the opening providing access to a roller contained within the enclosure. The enclosure further includes a bias spring that rotationally biases the roller within the enclosure, and a drawer with a rigid face that mates with the opening of the enclosure. The drawer has a flexible bottom that unrolls from the roller as the rigid face extends outwardly from the enclosure with the bias spring tensioning the flexible bottom as it unrolls to maintain a relatively flat surface for catching trimmed hairs. A collapsible arm assembly supports the rigid face and flexible bottom to the enclosure and collapses into the enclosure as the rigid face is retracted into the opening of the enclosure.

In one particular embodiment the hair catching and storage device includes a plurality of suction cups extending outwardly from the enclosure opposite the opening for attaching the enclosure to a mirror. In another particular embodiment the hair catching and storage device pre-biases the bias spring to provide tension to the flexible sheet with the rigid face fully retracted to the top enclosure. The bias spring may be, for example, a spiral torsion spring or a clock spring. The rigid face may include a handle extending outwardly from the enclosure to provide easy access to open and close the drawer.

In a further embodiment, the enclosure includes a pad touching the surface of the flexible sheet on the roller such that a static electrical charge is induced onto the flexible sheet as the sheet is unrolled from the roller. The pad may be, for example, a felt pad, an artificial felt pad, a leather pad, an artificial leather pad or other suitable material. In other embodiments, the collapsible arm assembly is lockable in an open position. The collapsible arm assembly may collapse into the top enclosure beneath the roller.

In one particular embodiment, a hair catching and storage device may include a back plate having a back plate top edge, a back plate bottom edge, a back plate left edge and a back plate right edge; a top plate having a top plate rear edge, a top plate front edge, a top plate left side edge and a top plate right side edge, wherein the top plate rear edge is rigidly fixed to the back plate top edge; a left side plate having a left side plate top edge, a left side plate bottom edge, a left side plate back edge and a left side plate front edge, wherein the left side plate top edge is rigidly fixed to the top plate left side edge and the left side plate rear edge is rigidly fixed to the back plate left side edge; a right side plate having a right side plate top edge, a right side plate bottom edge, a right side plate back edge and a right side plate front edge, wherein the right side plate top edge is rigidly fixed to the top plate right side edge and the right side plate rear edge is rigidly fixed to the back plate right edge the back plate, top plate left side plate and right side plate forming a top enclosure; a rigid front plate, wherein the rigid front plate is retractably coupled to the top enclosure by a collapsible arm assembly; a roller within the top enclosure extending from the left side plate to the right side plate, the roller rotatably coupled to the left side plate and the right side plate; a bias spring having a first end and a second end, the first end fixed to the top enclosure and the second end fixed to the roller, the bias spring biasing rotation of the roller within the top enclosure; a flexible sheet having a flexible sheet front edge and a flexible sheet rear edge, the flexible sheet front edge attached to the rigid front plate and the flexible sheet rear edge attached to the roller, wherein bias of the bias spring rolls the flexible sheet onto the roller as the rigid front plate is retracted to the top enclosure; and a bin movably coupled to the top enclosure, the bin having an enclosed space extending from the back plate to the rigid front plate beneath the roller and extending from the left side plate bottom edge to the right side plate bottom edge.

In some embodiments the left side plate may have a left side plate hole and the right side plate may have a right side plate hole, and the bin may have a left side pin that releasably fits within the left side plate hole and a right side pin that releasably fits within the right side plate hole such that the bin is removable from the top enclosure by moving at least one of the left side pin or right side pin out of its hole. In other embodiments the hair catching and storage device may include a bin that has a rear edge coupled to the back plate bottom edge using a hinge, such as, for example, a piano hinge.

In another embodiment, the hair catching and storage device's collapsible arm assembly may have a left side collapsible arm with a first left arm portion and a second left arm portion, a first rotatable joint that rotatably couples the first left arm portion to the left side plate, a second rotatable joint that rotatably couples the first left arm portion to the second left arm portion, and a third rotatable joint that rotatably couples the second left arm portion to a left side of the rigid front plate, and a right side collapsible arm having a first right arm portion and a second right arm portion, a first rotatable joint that rotatably couples the first right arm portion to the right side plate, a second rotatable joint that rotatably couples the first right arm portion to the second right arm portion, and a third rotatable joint that rotatably couples the second right arm portion to a right side of the rigid front plate. The collapsible arm assembly may be lockable in an open position to hold the drawer open. When closed, the collapsible arm assembly may collapse into the top enclosure beneath the roller.

In another embodiment, a method of using a hair catching and storage system involves the steps of: providing a housing containing a rolled hair catching surface; extending the hair catching surface from the housing; statically charging the hair catching surface; catching trimmed hair on the statically charged surface; retracting the hair catching surface back into the housing; discharging the static charge; and releasing the caught hair into a bin of the housing for ease of storage and disposal.

In a further embodiment a method of using a hair catching and storage system involves the steps of: providing a housing containing a flexible hair catching surface rolled onto a roller within the housing, the flexible hair catching surface connected to a drawer of the housing, the housing removably connected to a bin beneath the roller; extending the hair catching surface from the housing by pulling out the drawer; catching trimmed hair on the flexible hair catching surface; retracting the hair catching surface back into the housing, thereby releasing the trimmed hair into the bin; and removing the bin from the housing.

In other embodiments the method may further involve one or more of the steps of statically charging the flexible hair catching surface as the flexible hair catching surface is unrolled from the roller; discharging the flexible hair catching surface as the drawer is closed, thereby releasing the trimmed hair into the bin; disposing of the trimmed hair from the bin; and replacing the bin onto the housing after disposing of the trimmed hair.

BRIEF DESCRIPTION OF THE DRAWINGS

The present disclosure will be more readily understood from a detailed description of some example embodiments taken in conjunction with the following figures.

DETAILED DESCRIPTION

Figure 1:
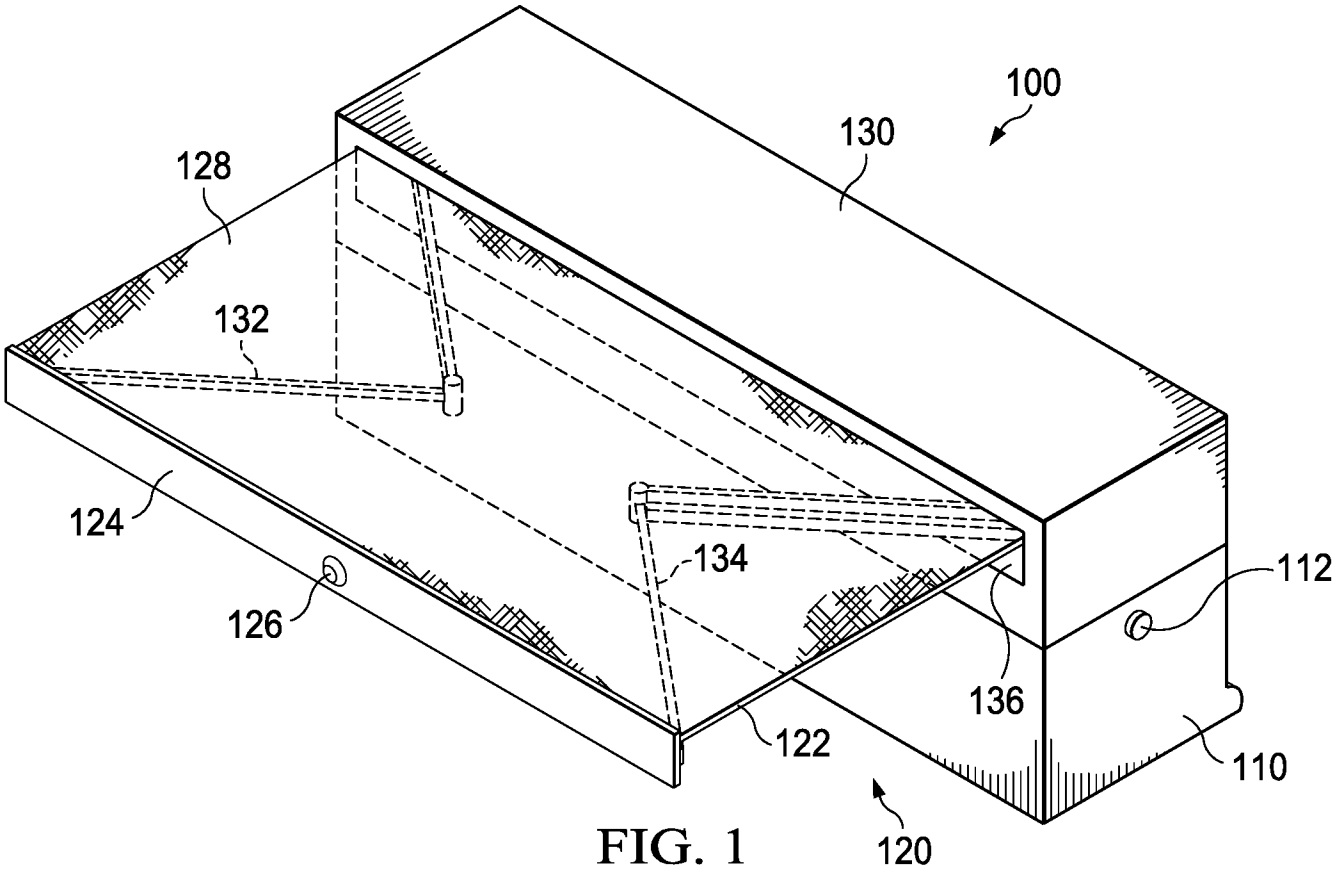
FIG. 1 is a perspective view of a device for catching, holding and disposing trimmed hair.

Various non-limiting embodiments of the present disclosure will now be described to provide an overall understanding of the principles of the structure, function, and use of the apparatuses, systems, methods, and processes disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment," or "in an embodiment" in places throughout the specification are not necessarily all referring to the same embodiment. Furthermore, the particular features, structures or characteristics may be combined in any suitable manner in one or more embodiments.

Described herein are example embodiments of apparatuses, systems, and methods for catching, holding and disposing trimmed hair. In one example embodiment, the system is attachable to a smooth surface using suction cups. In some embodiments, the device utilizes an off-the-shelf window shade as its hair catching surface. In some embodiments, the hair catching surface may be charged with a static charge to attract trimmed hair. In some embodiments, the hair catching surface may be charged with a static charge to attract trimmed hair as the surface is opened from a rolled up position, and discharged from its static charged as the surface is rolled back into its rolled up position to release the caught hair into a catch bin for storage and disposal.

The examples discussed herein are examples only and are provided to assist in the explanation of the apparatuses, devices, systems and methods described herein. None of the features or components shown in the drawings or discussed below should be taken as mandatory for any specific implementation of any of these the apparatuses, devices, systems or methods unless specifically designated as mandatory. For ease of reading and clarity, certain components, modules, or methods may be described solely in connection with a specific figure. Any failure to specifically describe a combination or sub-combination of components should not be understood as an indication that any combination or sub-combination is not possible. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

Example embodiments described herein can catch, hold, and dispose of trimmed beard hairs. For example, trimmed beard hairs from grooming can be caught before they scatter onto a sink or vanity and cause a difficult mess to clean. Additionally, or alternatively, trimmed beard hairs can be stored between multiple grooming sessions so that they may be easily disposed of at longer intervals, saving time and effort.

Prior art designs of beard hair catching devices typically attach around the user's neck, making the catch area smallest near the neck where trimmed hairs can miss the catch surface. Furthermore, the prior art devices may be uncomfortable to the user and limit motion as the trimming is performed because they are attach around the neck. As the head is turned and arm is lifted to trim the sides of the face, the surface area to catch the trimmings moves away and decreases substantially toward the users neck in the prior art devices. Also, hair trimmings do not all fall straight down, so they may miss the catch surface of designs where the surface nearest the user is narrower than the surface farthest from the user.

Another advantage between example embodiments and prior art designs is the cleanup and disposal of the hair. For example, in a bib type design of prior art devices, after shaving, you must disconnect the bib and then allow the hair to slide off into a small bathroom trash bin. Hair trimmings do not always slide well and would require shaking of the bib, causing some hair to miss the trash bin. Hair that does not come off of the bib will create a mess with storing and when pulling it out to set up again and disposal occurs after every use.

Example embodiments attach to the mirror or wall with suction cups, Velcro, double-sided tape, by hanging on a lip, or other attachment system, but are not attached to the user. A handle that may be provided on the front may be pulled out to extend a trimmed beard hair catching surface beneath the user's beard. The surface may be provided by a flexible cloth-like material similar to a window shade, but without a clutch on the spring roller, to keep constant tension on the material as it is pulled out or pushed back in. The extension mechanism may be hidden beneath the hair catching surface and provide structure that supports the front panel while the material providing the hair catching surface is extended, and prevents the coil spring from rolling the hair catching surface back up until the user desires closing the system. When finished grooming, the handle is pushed back in as the coil spring roller maintains tension on the shade and the extending mechanism collapses. As the material rolls up, the hair trimmings on the surface fall off into a catch bin that is attached to the mounted mechanism. The catch bin may have release tabs/clips on each side that allow it to be detached from the mounted housing to be easily dumped in the trash. The catch bin can hold many shaving's worth of hair and would not need to be emptied often.

Additional versions and functions are provided in alternate embodiments. To aid in the catching of the trimmings, pulling the handle out may catch a lever that pushes a felt (or other material) pad against the top surface of the shade as it slides out, creating a static charge on the shade. The static charge would draw trimmings to the shade that might otherwise miss. When the shade is pushed back in, the extension mechanism may catch the lever in the other direction, lifting the felt pad and contact the surface with a conductive piece to remove the static charge, allowing the hair to fall off the shade into the bin as it rolls back up. In alternate embodiments, the top of the housing could be used as a shelf. In further embodiments, the system may be built into a vanity or shelf unit.

FIG. 1 is a perspective view of a device for catching, holding and disposing of trimmed hair. Referring to FIG. 1, a grooming system 100 is illustrated that catches hair trimmings that fall when trimming hair, such as, for example, when trimming a man's beard. Men typically look in a mirror to accurately trim their beard, allowing the trimmings to fall and scatter around the sink and vanity countertop if they do not have a method to catch the trimmings. This creates a mess that is difficult and time consuming to clean up. The mess created from this common task is well known. The device illustrated in FIG. 1 is suitable for catching beard hair trimmings, depositing the trimmings into a bin after the trimming process, holding the trimmings until a convenient disposal time, and easily disposing of the trimmings at desired intervals.

Example embodiments of the grooming system 100 may stay mounted to a mirror at a grooming area and provide ready access to catch and store hair trimmings. Embodiments of the grooming system 100 may catch and store the hair, only requiring occasional dumping of a removable catch bin 110. Embodiments of the grooming system 100 may include an easily extendable or retractable tray-like material 120 with no time required by the user to put on or take off the grooming system 100 between uses. Embodiments of the grooming system 100 may include a sturdy shade 122, rather than loose hanging bib, that catches the hair and rolls up for easy disposal.

Still referring to FIG. 1, the grooming system 100 includes the tray-like material 120 having the sturdy shade 122 connected between a front panel 124 and an opening 136 in a housing 130 of the grooming system 100. The sturdy shade 122 provides a hair trimming catch surface 128 for catching hair trimmings. The sturdy shade 122 is extendable and retractable into the housing 130 by rolling and unrolling as the front panel 124 is pulled out from the housing 130 using a handle 126. For example, the front panel 124 may be rigid to support the sturdy shade 122 horizontally as the user trims his beard. An extension mechanism 160 includes a left extension arm 132 and a right extension arm 134 provided below each side of the sturdy shade 122 to provide a counter force to the tension of the sturdy shade 122. One or both of the left extension arm 132 and right extension arm 134 may be lockable, such as by providing a stop at a joint as will be illustrated further below.

A right side pin or right side push clip 112, may be provided to allow easy removal of the removable catch bin 110 from the housing 130 for disposing of hair trimmings. The right side push clip 112 may be depressed and the removable catch bin 110 may be slid down and off the housing 130, containing the trimmed hair. The removable catch bin 110 may be carried to a trash bin and the removable catch bin 110 may be inserted deep into the bin and shaken so that hairs stay in the trash bin and do not scatter and make a mess.

Figure 2:
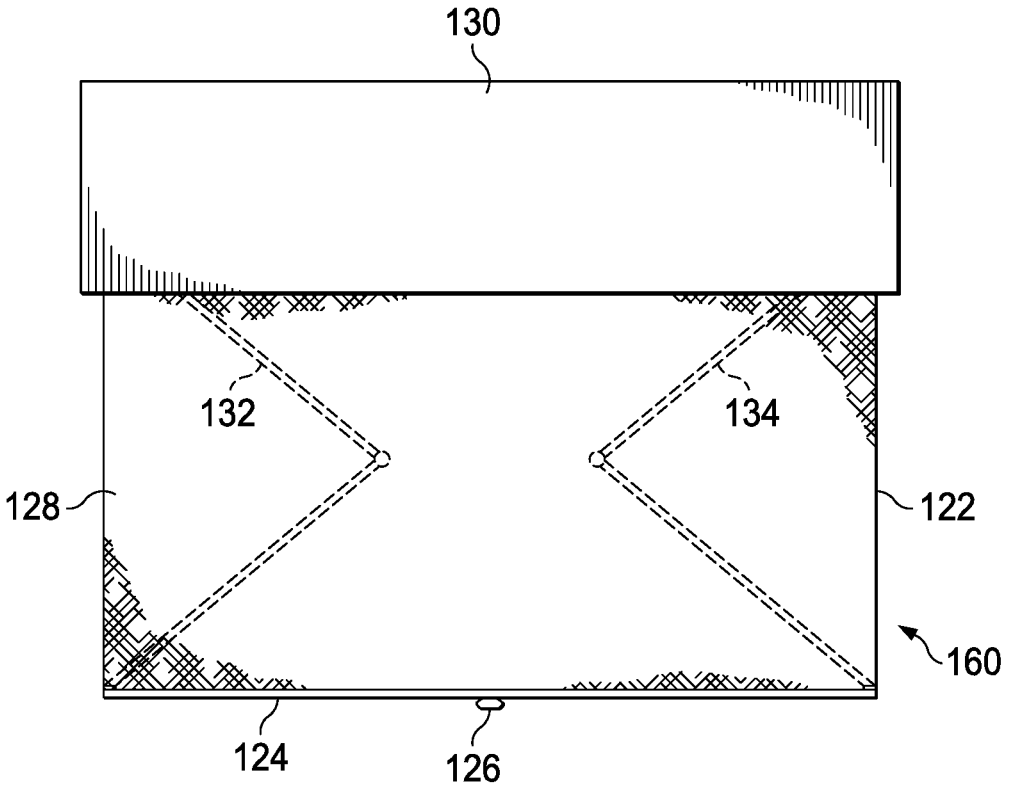
FIG. 2 depicts a top view of a system for catching, holding and disposing trimmed hair according to one embodiment, with the trimming catch surface partially open.

FIG. 2 depicts a top view of the grooming system 100 for catching, holding and disposing trimmed hair according to one embodiment, with the hair trimming catch surface 128 partially open. The left extension arm 132 and right extension arm 134 are illustrated in a partially folded state, illustrating how they fold into and out of the housing 130 as the handle 126 is pulled to open or released to close the hair trimming catch surface 128. When the housing 130 is fully closed, the sturdy shade 122, left extension arm 132 and right extension arm 134 may be enclosed within the housing 130 and the front panel 124 may be flush with the housing 130.

Figure 3:
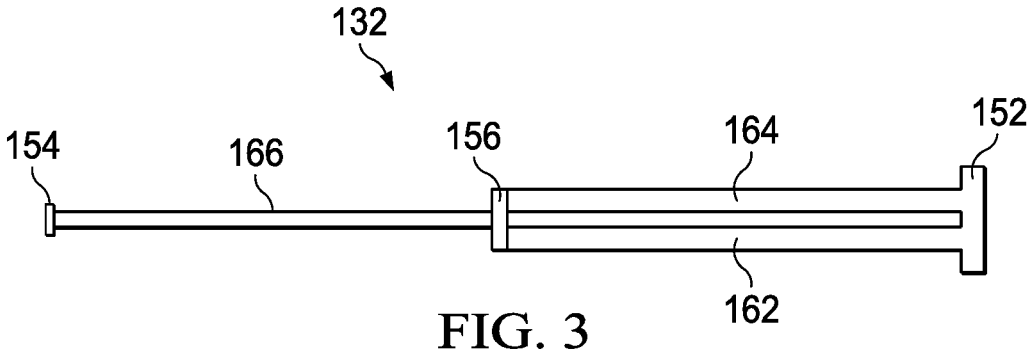
FIG. 3 is a side view of the folding arms shown in FIGS. 1 and 2.

FIG. 3 is a side perspective view of the folding arms shown in FIGS. 1 and 2. The left extension arm 132 is illustrated in FIG. 3, but may be substantially the same and interchangeable with the right extension arm 134. A first pin 152 may be connected to a first beam 162 and a second beam 164. The first beam 162 and second beam 164 extend from the first pin 152 to a locking pin 156. The locking pin 156 may provide a locking joint, or may alternately provide a non-locking joint. A third beam 166 extends from the locking pin 156 to a second pin 154. The second pin 154 may be connectable to the front panel 124, and the first pin 152 may be connectable to the interior of the housing 130 using holes or openings in the front panel 124 and housing 130 to provide rotatable support to the left extension arm 132. This rotatable support allows the left extension arm 132 to extend and retract the hair trimming catch surface 128 from a stored position to a catching or open position.

As illustrated in FIGS. 1 through 3, the third beam 166 is configured to fit between the first beam 162 and the second beam 164 in the closed position allowing a compact closed housing 130 when the grooming system 100 is not in use. As the handle 126 is pulled and the front panel 124 is extended from the housing 130, the extension mechanism 160 provides substantially rigid support of the sturdy shade 122 and hair trimming catch surface 128 in the vertical direction while allowing movement in the horizontal direction to open and close the grooming system 100.

Figure 4:
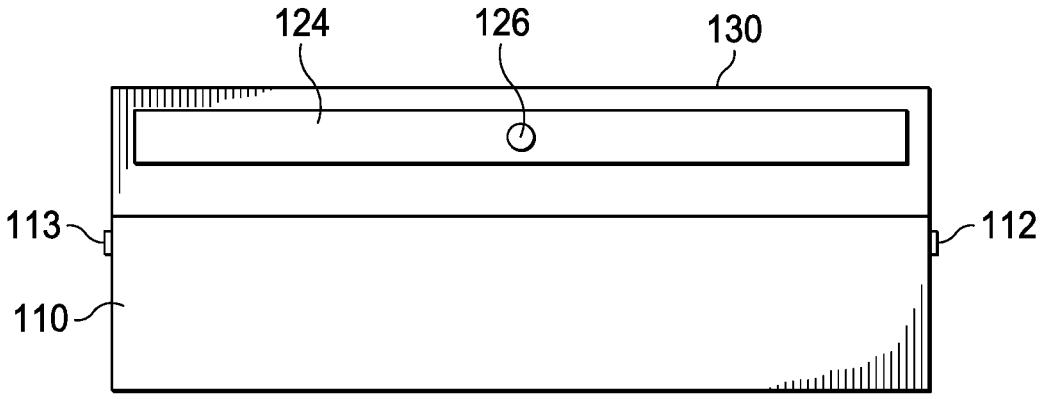
FIG. 4 is a front view of a device for catching, holding and disposing trimmed hair.

FIG. 4 is a front view of the grooming system 100 for catching, holding and disposing trimmed hair. The embodiment illustrated in FIG. 4 illustrates a left side push clip 113 on the left side of the housing 130. In order to remove the removable catch bin 110 from the housing 130 illustrated in FIG. 4, both the left side push clip 113 and the right side push clip 112 should be depressed simultaneously to remove the removable catch bin 110 from the housing 130. Alternately the right side push clip 112 may be provided on the right side and a slot or pin may be used on the left side in order to reduce the number of parts of the grooming system 100.

The width of the housing 130 of the grooming system 100 may be, for example, about 15 inches (about 38.1 centimeters) to about 30 inches (about 76.2 centimeters), and preferably may be about 24 inches (about 60.96 centimeters) wide. The height of the housing 130 may be, for example, about 3 to 8 inches (about 7.62 to 20.32 centimeters), and preferably may be about 4 inches (about 10.16 centimeters). In alternate embodiments, wider housing 130 sizes may be used. The depth of the housing 130 may be, for example, about 2 inches (about 5.08 centimeters) to about 7 inches (about 17.78 centimeters) and may be preferably about 3 inches (about 7.62 centimeters) deep. The hair trimming catch surface 128 in its fully extended position may be, for example, about 12 to about 24 inches (about 30.48 to about 60.96 centimeters), and preferably may be about 12 inches (about 30.48 centimeters) to about 16 inches (about 40.64 centimeters) extended from the housing 130. The housing 130 may be manufactured from stainless steel, Aluminum, steel or plastic such as, for example ABS plastic.

Figure 5:
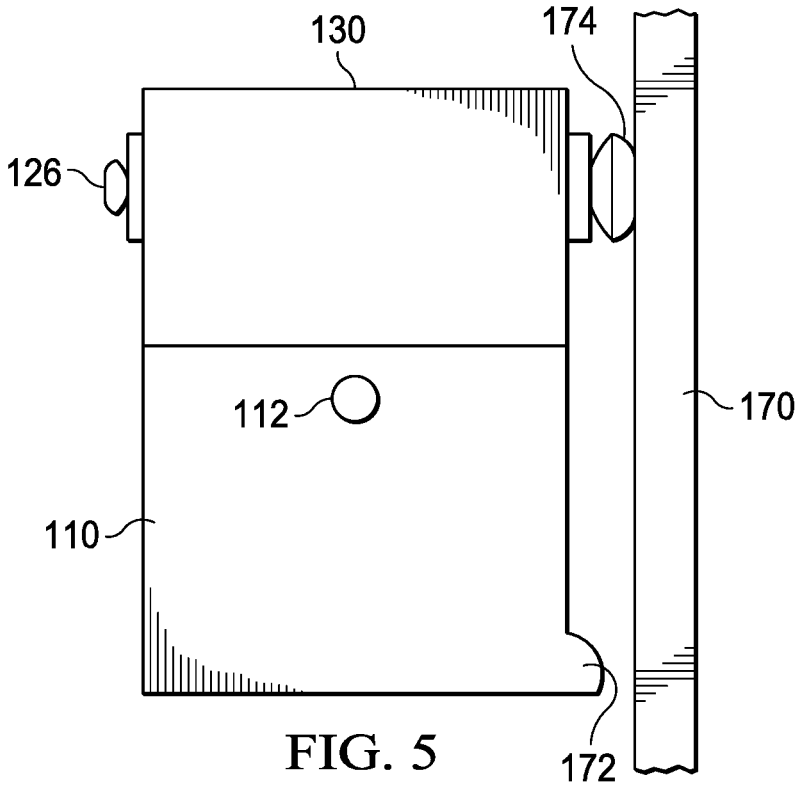
FIG. 5 is a side view of a device for catching, holding and disposing trimmed hair, with the device in its closed position.

FIG. 5 is a side view of the grooming system 100, with the device in its closed position. The grooming system 100 is illustrated mounted to a mirror 170, via a suction cup 174. The suction cup 174 holds the housing 130 to the mirror 170. It may be useful to provide a plurality of suction cups 174 to support the housing 130 solidly to the mirror 170. It may be preferable to provide at least three suction cups 174, and preferably five suction cups 174 to provide for a solid attachment of the housing 130 to the mirror 170. In alternate embodiments, the suction cup 174 may be replaced with a lip in the housing 130 that can be hung onto a ridge mounted to the mirror 170, or a ridge provided in a support for the grooming system 100 in other arrangements. Other attachment mechanisms such as double sided tape, Velcro or other attachment mechanisms may be used.

A bottom support 172 may be provided to provide alignment of the housing 130 to the mirror 170. The bottom support 172 may be formed into the housing 130, or may be, for example, a rubber foot screwed into the housing 130, a cork pad adhered to the housing 130 via glue or tape, or other mechanism of providing alignment of the housing 130 with the mirror 170.

Figure 6:
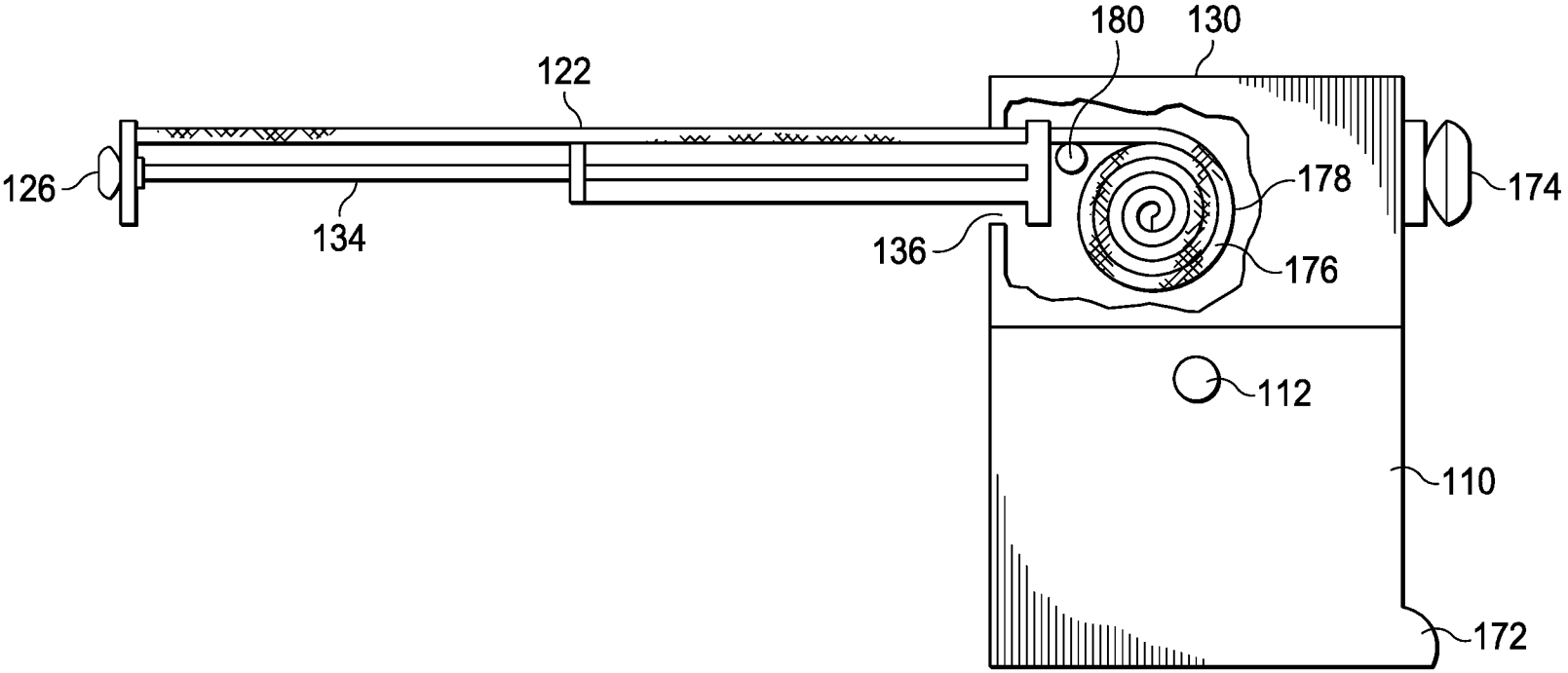
FIG. 6 is a side view of a device for catching, holding and disposing trimmed hair with the device in its open position, illustrating internal components of the system.

FIG. 6 is a side view of the grooming system 100 with the device in its open position, illustrating internal components of the system. The sturdy shade 122 is rolled and unrolled from a roller 178 while under tension from a spring 176 similarly to how a blind on a window is open and closed. A rod 180 provides a support within the housing 130 to flatten the sturdy shade 122 and support it as it is rolled off the roller 178 and extended, providing the hair trimming catch surface 128.

The sturdy shade 122 may be manufactured from cloth, polymer, or other suitable material. For example, the sturdy shade 122 may be formed from straw strands held together with string that provide lateral support, but allow rolling of the sturdy shade 122 onto the roller 178, for example, similarly to a straw matt that is flexible and can be rolled up, but supports lateral loading such as a beach matt. In some embodiments, the sturdy shade 122 may be formed from a polymer sheet, such as, for example, Teflon.

The tray-like material 120 may be capable of maintaining a static charge, such that as the tray-like material 120 is unrolled from the roller 178, a felt pad or other material may rub against the tray-like material 120 as it is extended from the housing 130, providing a static charge to the tray-like material 120 that attracts trimmed hairs to the tray-like material 120. As the tray-like material 120 is retracted on rolled back onto the roller 178, the tray-like material 120 may be discharged so that the trimmings are released into the removable catch bin 110. For example, the rod 180 may be covered by felt that charges the hair trimming catch surface 128 as the tray-like material 120 is unrolled from the roller 178. The spring 176 may then discharge the charge provided to the hair trimming catch surface 128 as the tray-like material 120 is rolled back onto the roller 178 when the extension mechanism 160 is retracted back into the housing 130, allowing the trimmed hair to be deposited into the removable catch bin 110.

Figure 7:
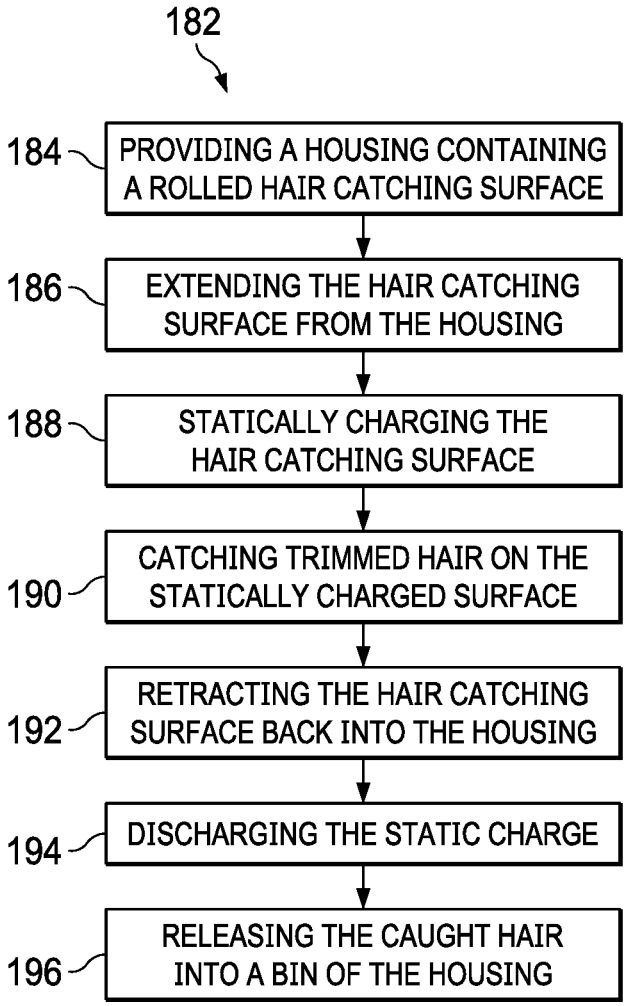
FIG. 7 is a flow chart of a method for catching, holding and disposing trimmed hair.

FIG. 7 is a flow chart of a method for catching, holding and disposing trimmed hair 182. The method for catching, holding and disposing trimmed hair 182 includes one or more of the steps of providing a housing containing a rolled hair catching surface 184, extending the hair catching surface from the housing 186, statically charging the hair catching surface 188, catching trimmed hair on the statically charged surface 190, retracting the hair catching surface back into the housing 192, discharging the static charge 194 and releasing the caught hair into a bin of the housing 196.

In various embodiments disclosed herein, a single component can be replaced by multiple components and multiple components can be replaced by a single component to perform a given function or functions. Except where such substitution would not be operative, such substitution is within the intended scope of the embodiments. Some of the figures can include a flow diagram. Although such figures can include a particular logic flow, it can be appreciated that the logic flow merely provides an exemplary implementation of the general functionality. Further, the logic flow does not necessarily have to be executed in the order presented unless otherwise indicated.

The foregoing description of embodiments and examples has been presented for purposes of illustration and description. It is not intended to be exhaustive or limiting to the forms described. Numerous modifications are possible in light of the above teachings. Some of those modifications have been discussed, and others will be understood by those skilled in the art. The embodiments were chosen and described in order to best illustrate principles of various embodiments as are suited to particular uses contemplated. The scope is, of course, not limited to the examples set forth herein, but can be employed in any number of applications and equivalent devices by those of ordinary skill in the art. Rather it is hereby intended the scope of the invention to be defined by the claims appended hereto.

I claim:

1. A hair catching and storage device comprising:

a back plate having a back plate top edge, a back plate bottom edge, a back plate left edge and a back plate right edge;

a top plate having a top plate rear edge, a top plate front edge, a top plate left side edge and a top plate right side edge, wherein the top plate rear edge is rigidly fixed to the back plate top edge;

a left side plate having a left side plate top edge, a left side plate bottom edge, a left side plate back edge and a left side plate front edge, wherein the left side plate top edge is rigidly fixed to the top plate left side edge and the top plate rear edge is rigidly fixed to the left side plate back edge;

a right side plate having a right side plate top edge, a right side plate bottom edge, a right side plate back edge and a right side plate front edge, wherein the right side plate top edge is rigidly fixed to the top plate right side edge and the top plate rear edge is rigidly fixed to the right side plate back edge, wherein the top plate, the left side plate, and the right side plate cooperate to form a top enclosure;

a rigid front plate, wherein the rigid front plate is retractably coupled to the top enclosure by a collapsible arm assembly;

a roller within the top enclosure extending from the left side plate to the right side plate, the roller rotatably coupled to the left side plate and the right side plate;

a bias spring having a first end and a second end, the first end fixed to the top enclosure and the second end fixed to the roller, the bias spring configured to bias rotation of the roller within the top enclosure;

a flexible sheet having a flexible sheet front edge and a flexible sheet rear edge, the flexible sheet front edge attached to the rigid front plate and the flexible sheet rear edge attached to the roller, wherein bias of the bias spring is configured to roll the flexible sheet onto the roller as the rigid front plate is retracted to the top enclosure; and a bin movably coupled to the top enclosure, the bin having an enclosed space extending from the back plate to the rigid front plate beneath the roller and extending from the left side plate bottom edge to the right side plate bottom edge.

2. The hair catching and storage device of claim 1, wherein the left side plate has a left side plate hole and the right side plate has a right side plate hole, and wherein the bin has a left side pin that releasably fits within the left side plate hole and a right side pin that releasably fits within the right side plate hole such that the bin is removable from the top enclosure by moving at least one of the left side pin or right side pin out of its hole.

3. The hair catching and storage device of claim 1, wherein the bin has a rear edge coupled to the back plate bottom edge using a hinge.

4. The hair catching and storage device of claim 1, wherein the back plate of the top enclosure comprises a plurality of suction cups extending outwardly from the top enclosure.

5. The hair catching and storage device of claim 1, wherein the bias spring is biased to provide tension to the flexible sheet with the rigid front plate fully retracted to the top enclosure.

6. The hair catching and storage device of claim 1, wherein the rigid front plate includes a handle extending opposite the flexible sheet.

7. The hair catching and storage device of claim 1, wherein the bias spring is a spiral torsion spring.

8. The hair catching and storage device of claim 1, wherein the top enclosure includes a pad touching the flexible sheet such that a static electrical charge is inducible onto the flexible sheet as the flexible sheet is unrolled from the roller.

9. The hair catching and storage device of claim 8, wherein the pad comprises a felt material.

10. The hair catching and storage device of claim 1, wherein the collapsible arm assembly includes a left side collapsible arm having a first left arm portion and a second left arm portion, a first rotatable joint that rotatably couples the first left arm portion to the left side plate, a second rotatable joint that rotatably couples the first left arm portion to the second left arm portion, and a third rotatable joint that rotatably couples the second left arm portion to a left side of the rigid front plate, and a right side collapsible arm having a first right arm portion and a second right arm portion, a first rotatable joint that rotatably couples the first right arm portion to the right side plate, a second rotatable joint that rotatably couples the first right arm portion to the second right arm portion, and a third rotatable joint that rotatably couples the second right arm portion to a right side of the rigid front plate.

11. The hair catching and storage device of claim 10, wherein the collapsible arm assembly is lockable in an open position.

* * * * *